US006837783B2

(12) United States Patent
Hunt-Vincent et al.

(10) Patent No.: US 6,837,783 B2
(45) Date of Patent: Jan. 4, 2005

(54) COIN STORES AND COIN DISPENSERS

(75) Inventors: Will Hunt-Vincent, Yately (GB); Paul Fletcher, Camberley (GB)

(73) Assignee: Mars Incorporated, McLean, VA (US)

( * ) Notice: Subject to any disclaimer, the term of this patent is extended or adjusted under 35 U.S.C. 154(b) by 152 days.

(21) Appl. No.: 10/138,744

(22) Filed: May 3, 2002

(65) Prior Publication Data

US 2002/0187741 A1 Dec. 12, 2002

(30) Foreign Application Priority Data

May 4, 2001 (EP) ..... 01304067

(51) Int. Cl.[7] ..... G07D 1/00
(52) U.S. Cl. ..... 453/49; 453/44
(58) Field of Search ..... 453/18, 39, 40, 453/41, 42, 43, 44, 45, 49; 194/237, 238, 249, 250, 251, 252; 221/125, 208, 261

(56) References Cited

U.S. PATENT DOCUMENTS 1,356,379 A * 10/1920 McDermott ..... 453/41
3,191,609 A * 6/1965 Gausellman et al. ..... 453/40
3,376,967 A 4/1968 Fulhorst ..... 194/93
4,902,263 A * 2/1990 Ito et al. ..... 453/49
6,193,597 B1 2/2001 Choi ..... 453/32
6,488,577 B1 * 12/2002 Nakajima et al. ..... 453/44
2002/0038806 A1 * 4/2002 Senda et al. ..... 221/209

FOREIGN PATENT DOCUMENTS

EP 0 312 316 4/1989 ..... G07D/1/00
GB 2.274.190 A * 7/1994 ..... G07F/5/24
GB 2 335 775 9/1999 ..... G07D/1/02
JP 4-284589 A * 10/1992 ..... G07D/1/02
JP 6-162303 A * 6/1994 ..... G07D/1/00

* cited by examiner

*Primary Examiner*—Donald P Walsh
*Assistant Examiner*—Mark J. Beauchaine
(74) *Attorney, Agent, or Firm*—Fish & Richardson P.C.

(57) ABSTRACT

A base for a coin store comprises an essentially planar part for supporting a coin or coins and retaining means for retaining coins within the coin store in use, and the retaining means comprises at least one part extending essentially perpendicular to the planar part of the base.

24 Claims, 4 Drawing Sheets

COIN STORES AND COIN DISPENSERS

The invention relates to coin stores, especially coin storage tubes, as used, for example, in currency handling apparatus such as vending machines which store coins for supply as change. More specifically, the invention relates especially to bases for coin storage tubes.

It is well known to use tubes to store coins for supply as change in currency handling apparatus. Usually, several coin storage tubes are provided, each having different diameters to receive and store different denominations of coins. Valid coins accepted by the currency handling apparatus are sorted and directed to the appropriate tube. When change is required in a transaction, coins are removed from the coin storage tubes and directed to a coin return tray of the currency handling apparatus.

It is known to arrange a plurality of coin storage tubes within a coin cassette (see, for example, GB2246897). The coin storage tubes may be removable from the cassette and replaceable. In a known example of such an arrangement, the cassette includes a base part which extends in a direction transverse to the axis of the coin storage tubes to support the lowermost coin in each tube, and hence support the stack of coins in each tube. The base extends across approximately ¾ of the area of the corresponding coin tube, with a space underneath the rest of the coin tube. The base includes a slot beneath each tube. When the cassette is installed in the currency handling apparatus, a dispensing arm extends through each slot to contact the lowermost coin in each stack. When a coin is to be dispensed as change, the dispensing arm moves along the slot, forcing the lowermost coin out through a gap at the bottom of the respective tube and away from the tube. Each tube also includes a pair of flexible arms extending downwardly into the gap. Those arms serve to retain the lowermost coin in the tube, for example, when the cassette is being transported or installed in the currency handling apparatus. Because the arms are flexible, they can be pushed aside when the dispensing arm dispenses a coin.

A problem with the prior art is that coins can fall through or get stuck in the slot in the base for the dispensing arm, or fall through the space under the tube adjacent to the base part. This can occur especially when a coin enters an otherwise empty tube. Another problem is that the arms of the prior art can force the lowermost coin slightly down, which can result in the coin being jammed when it is being dispensed. In the prior art mentioned, the gap through which the coin is dispensed between the bottom of each tube and the base formed by the cassette may be the same for each tube. However, at least some of the tubes are for storing different denominations of coin, and thus the gap should correspond to the depth of the appropriate denomination, to avoid more than one coin being dispensed accidentally. Normally, the gap is modified by adding what is known as a "designator" to each tube suitable for the denomination of coin to be stored by the tube. This can add complexity and costs. Also, the arms need to be strong enough to hold the coins in the tubes, eg in transit, but sufficiently flexible that they can be moved aside to allow coins to be dispensed when required. This two requirements are in opposition, which means that compromise is required. Also, the arms can be quite flimsy and break off easily. Another problem is that third parties can attempt to remove coins from the tubes by inserting foreign objects through the space under the tube adjacent to the base part.

The present invention provides a base for a coin store, preferably a coin storage tube, as set out in claim 11, claim 18, or claim 26. In claim 26, vertical axis means the axis of the coin store, especially coin tube, for which the base is designed.

The invention also provides a coin store comprising such a base.

The invention also provides an assembly comprising a coin store, coin dispensing means and coin store opening means, which may be a base as set out above, the assembly being as set out in claim 1, claim 2 or claim 3, or a combination of the features of two or more of claims 1, 2 and 3.

As a result of the invention, coin retention means can be provided which prevent coins from falling out of the coin tube, but which do not interfere negatively with the dispensing operation or cause jams when there are only a few coins remaining in the coin tube, as in the prior art discussed above.

The invention also enables use of dispensing means, for example, a drag link, to open a coin store, thereby giving a controlled release of the coins. Providing coin retention means, that are pivotable about a substantially vertical axis, preferably from beneath the coin, can stop the coin from being pushed downwards and potentially jamming as it is released.

Embodiments of the invention will be described with reference to the accompanying drawings of which:

Figure 1:
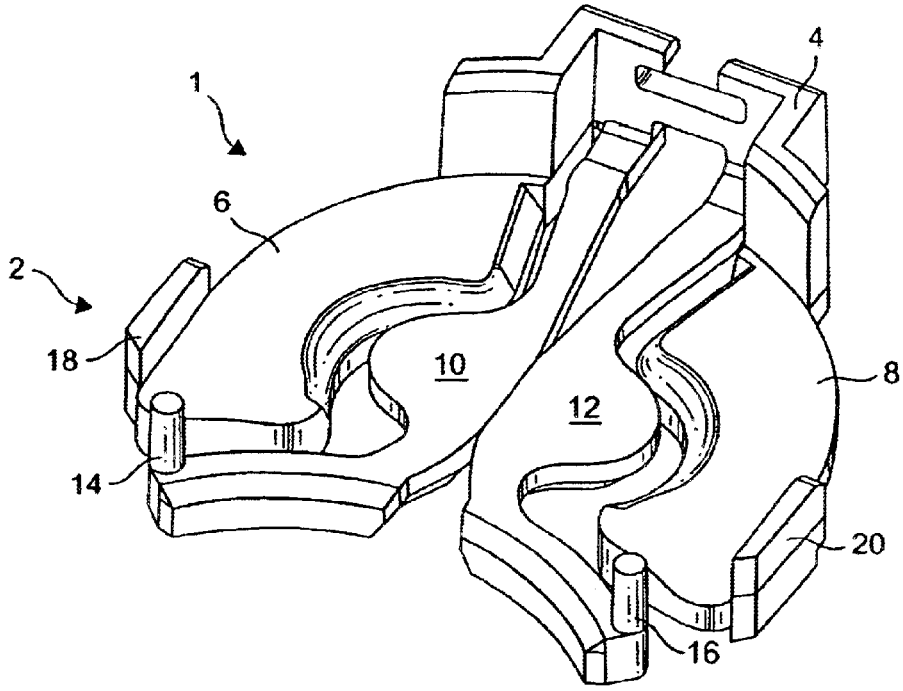
FIG. 1 is a top perspective view of a base for a coin storage tube.
Figure 2:
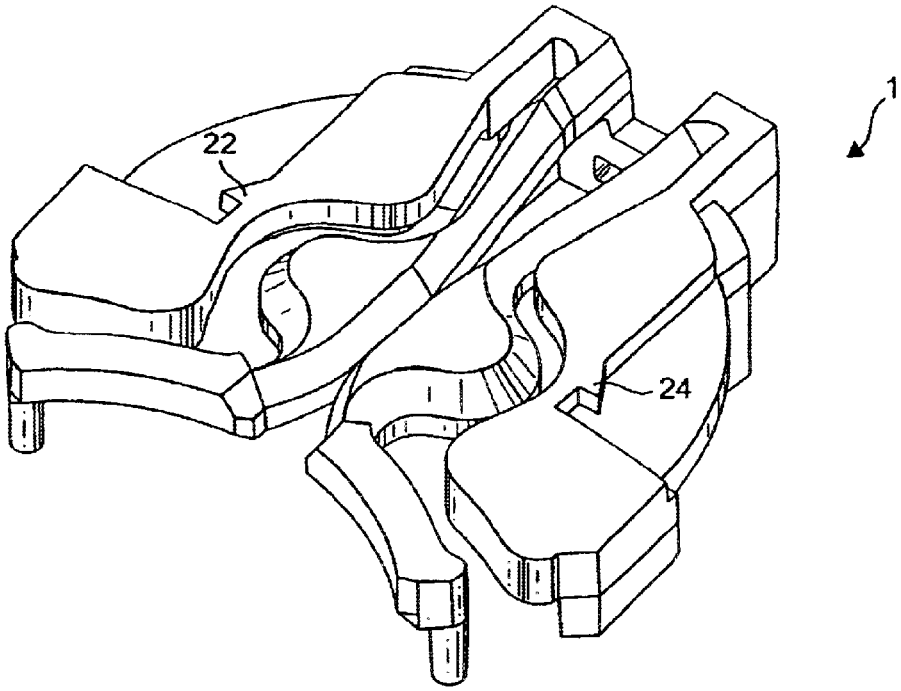
FIG. 2 is a bottom perspective view of the base of FIG. 1.

FIGS. 1 and 2 show a base 1 for a coin storage tube. The base 1 is designed to be attached to the bottom of a coin tube, to support a stack of coins in the tube and to enable the lowermost coin in the stack to be selectively dispensed from the tube.

The base 1 includes a support platform 2 for supporting a stack of coins. The support platform 2 is essentially planar, and is roughly circular, thus corresponding to the bottom of the coin tube to which it is to be attached. The base 1 also includes a rear wall 4 which extends substantially transversely to the support platform 2. The support platform 2 includes a pair of outer wings 6, 8 and a pair of central flexible, resilient, sprung fingers 10, 12. Each of the sprung fingers 10, 12 is connected at one end to the rear wall 4 and extends initially essentially diametrically before forming a scallop curve from a point approximately ¾ of the way across the diameter from the rear end. In the rear parts, the inner edges of the sprung fingers 10, 12 are spaced apart, but they meet in the central region of the base 1, where the sprung fingers 10, 12 together form a roughly circular base region. A coin retention peg 14, 16 is provided on the end of each sprung finger 10, 12 and extends substantially transversely to the plane of the sprung fingers 10, 12. Each of the outer wings 6, 8 is also connected to the rear wall 4 at one end, on either side of the sprung fingers 10, 12, and extends circumferentially around a respective sprung finger. The inner edge of each outer wing 6, 8 is shaped to match the profile of the outer edge of the adjacent sprung finger 10, 12, but the inner edges of the outer wings 6, 8 and the outer edges of the sprung fingers 10, 12 are spaced apart. The outer edge of each outer wing 6, 8 is approximately circular, to match the shape of the bottom of a coin tube. A circumferential outer wall 18, 20 is connected to the front end of each outer wing 6, 8 and extends substantially transversely to the wing 6, 8.

As shown in FIG. 2, the underneath of the base has a pair of projections 22, 24 formed on the underneath of the outer wings 6, 8 for attaching the base to a coin tube.

The entire base is moulded from plastics material, although other resilient materials may be used. Preferably, each base is designed according to the type of tube (ie diameter) it is to be used with, and the type of coin (ie thickness of the coin).

Figure 3:
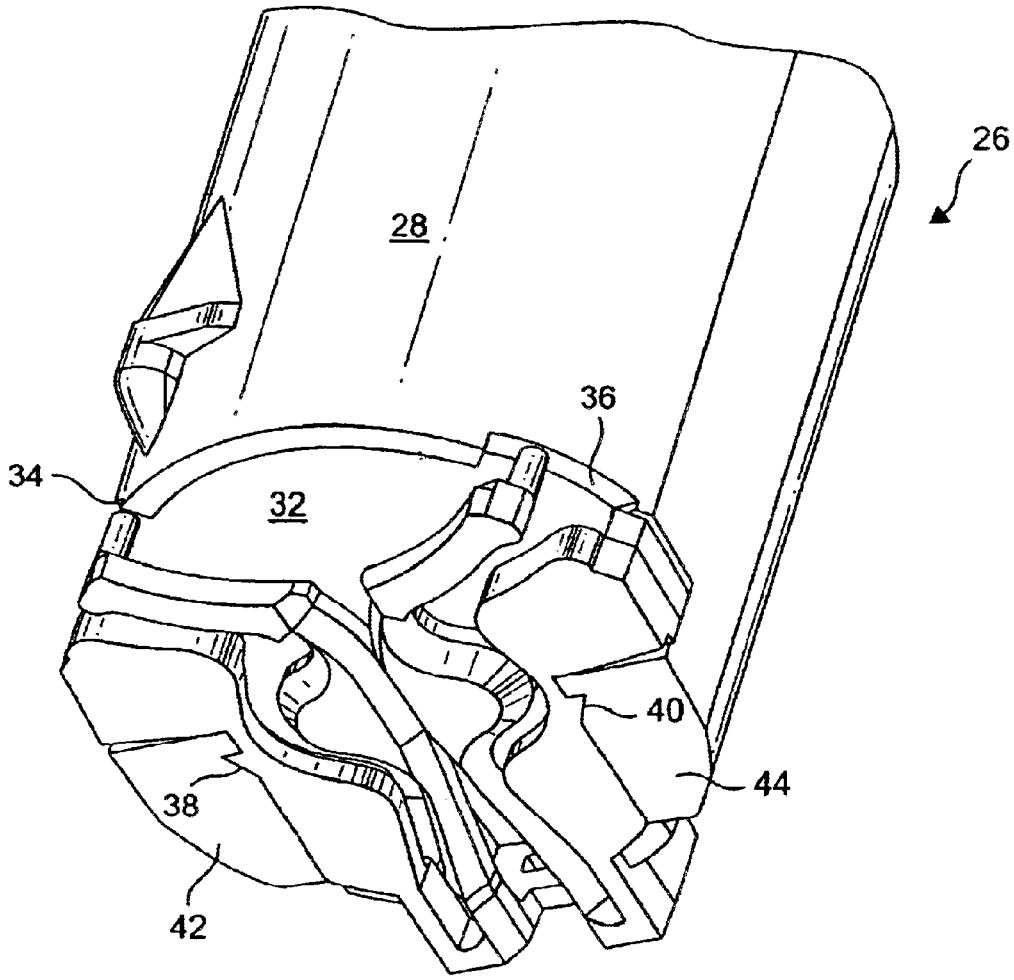
FIG. 3 is a view from below of the base of FIGS. 1 and 2 attached to a coin tube.

FIG. 3 shows the base 1 fitted to the coin tube 25. The tube 26 is formed of an outer wall 28 extending in the direction of the tube axis. The bottom part of the outer wall 28 of the tube 26, where the base 1 is fitted, has a pair of gaps 30, 32. The first gap 30 is for receiving part of the rear wall 4 of the base 1. The second gap 32 is diametrically opposite to the first gap 30 and is for receiving the front part of the base 1, and for allowing the lowermost coin to be removed from the coin tube 26, while the next coin is retained by the outer wall 28 of the tube 26. The second gap 32 can be seen in FIG. 3 and the first gap 30 can be seen more clearly in FIG. 5. As shown in FIG. 3, the lower part of the outer wall 28 of the coin tube 26 adjacent to the second gap 32 includes a pair of recesses 34, 36 for receiving the free ends of the coin retention pegs 14, 16. As shown, the projections 22, 24 on the underneath of the base 1 interlock with a pair of notches 38, 40, 28 formed in each of a pair of lower tube parts 42, 44 which extend from the bottom of the outer wall 28 of the tube 26 transversely to the axis of the tube 26.

Figure 5:
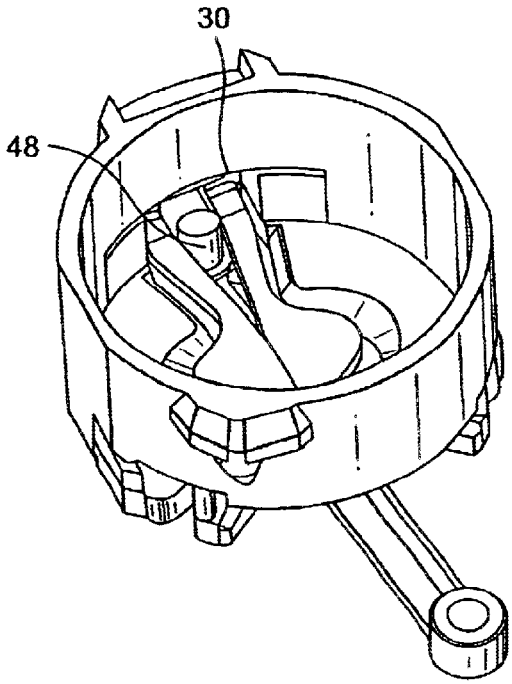
FIG. 5 is a view of the tube, base and dispensing arm corresponding to FIG. 4 but seen from above.

To attach the base 1 to the tube 26, the outer wings 6, 8 of the base are squeezed together and the base is clicked into place by forcing the projections 22, 24 into the notches 38, 40 on the underside of the coin tube 26. Part of the rear wall 4 of the base 1 fits into the first gap 39, as shown in FIG. 5. The outer walls 18, 20 connected to the outer wings 6, 8 fit into the rearwardmost parts of the second gap 32. The free ends of the coin retention pegs 14, 16 fit into the recesses 34, 36 in the outer wall 28 of the coin tube 26. In the rest position, the coin retention pegs 14, 16 are positioned towards the front end of the recesses 34, 36, that is, away from the walls 18, 20 connected to the outer wings 6, 8. Similarly, the base can be removed from the tube by disengaging the projections 22, 24 from the notches 38, 40.

In this embodiment, the outer wings 6, 8 are slightly under compression when the base is fitted to the tube 26. However, the inner edges of the outer wings 6, 8 are still spaced from the outer edges of the sprung fingers 10, 12, at least towards the front parts of the sprung fingers 10, 12.

Figure 4:
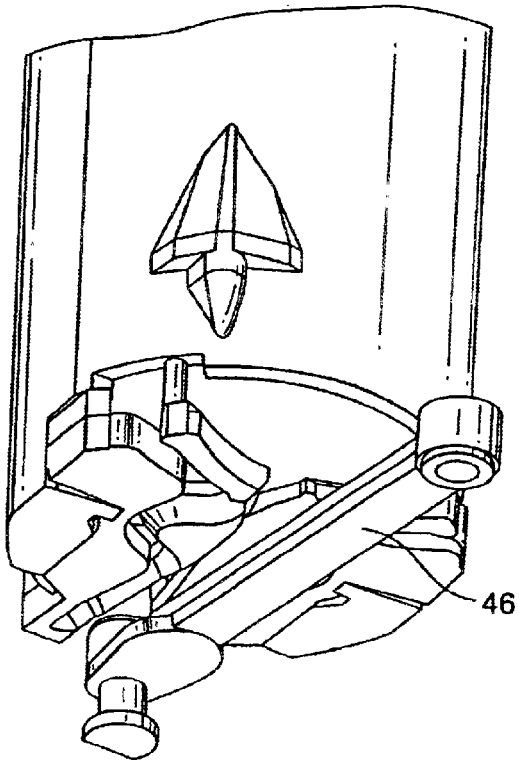
FIG. 4 is a view showing a dispensing arm interacting with the base and tube as shown in FIG. 3.

FIGS. 4 and 5 show coin dispensing means interacting with the base 1 attached to the coin tube 26. The coin dispensing means is in the form of a drag link having an arm 46 extending below the base 1 and the coin tube 26 and a projection 48 which extends between the sprung fingers 10, 12 in the base 1. Movement of the drag link is controlled by a motor (not shown). FIGS. 4 and 5 show a single tube, base and dispensing means. Normally, there are several such arrangements mounted within a currency handling mechanism. Furthermore, the coin tubes may be mounted within a coin cassette, as previously described (see GB2246897).

A dispensing operation will now be described.

In the position shown in FIGS. 4 and 5, the dispensing means is in the rest position, with the projection 48 of the drag link extending through the space between the rear parts of the sprung fingers 10, 12. A stack of coins (not shown) in the coin tube is supported on the base 1, specifically on the upper faces of the outer wings 6, 8 and sprung fingers 10, 12. The projection 48 of the drag link extends into the first gap 30 of the coin tube 26 and rests on the rear edge of the lowermost coin in the coin stack. The coin retention pegs 14, 16 rest on the front edge of the lowermost coin in the coin stack and prevent that coin from falling or dropping out of the coin tube 26. The other coins in the coin stack are retained in the coin tube by the outer wall 28.

When a coin is to be dispensed from the coin tube, the drag link is moved by the motor so that the projection 48 moves diametrically with respect to the coin tube 26 between the inner edges of the sprung fingers 10, 12. As the projection 48 moves towards the central part of the sprung fingers 10, 12, it acts on the sprung fingers 10, 12 and forces them apart. At the same time, the projection 48 acts on the rear of the lowermost coin in the stack and forces it towards the gap (second gap 32) in the tube wall 28. As a result of the action of the projection 48 on the sprung fingers 10, 12, the coin retention pegs 14, 16 move circumferentially away from each other in the recesses 34, 36, thus allowing the coin to be pushed out of the tube through the second gap 32. The scalloped front edge of the sprung fingers 10, 12 enables the coin to be more easily dispensed. In this embodiment, the projection 48 contacts and acts on the sprung fingers 10, 12 before it contacts and acts on the coin, so that the coin retention pegs 14, 16 start to move apart before the coin starts to move, thus enabling a controlled exit of the coin.

After the drag link has reached its limit position (when at least half of the coin has passed through the second gap 32 beyond the coin retention pegs 14, 16 so that the coin is dispensed) it returns to the original rest position, so that the projection 48 moves back in the opposite direction. Accordingly, gradually the sprung fingers 10, 12 return to the rest position by virtue of the movement of the projection 48 and the resilience in the sprung fingers 10, 12.

After the coin is dispensed, and the projection 48 of the dispensing means and the base 1 have returned to their rest position, the coin stack in the tube moves down under gravity so that the next coin rests on the base 1.

In this embodiment, the profile of the sprung fingers 10, 12 and the locus of the projection 48 is such that the coin retention pegs 14, 16 move apart before the coin reaches the gap 32, so that the coin exit is smooth and controlled. Alternatively, the profile may be made such that a force on the rear of the coin is built up before the coin retention pegs 14, 16 are spaced apart sufficiently to allow a coin to pass through. This results in the coin shooting out of the gap 32 more quickly. Similarly, when the sprung fingers 10, 12 return, the coin retention pegs 14, 16 can be made to act on the rear edge of the dispensed coin, thus adding impetus to the dispensed coin. Also, the sprung fingers 10, 12 and the dispensing means can be formed such that the projection 48 moves out of contact with the sprung fingers 10, 12 at a certain point in its return journey, thus allowing the fingers 10, 12 to spring back into the rest position, which can add impulse to the rear of the dispensed coin.

In an alternative embodiment, the base can be formed in a "sprung out" configuration, such that, on assembly, the sprung fingers 10, 12 are forced closer together. This can allow maximum deflection of the sprung fingers 10, 12 when acted on by the projection 48 of the drag link. For example, this could be achieved by making the gap between the outer wings 6, 8 and the sprung fingers 10, 12 smaller at the rear part, so that when the outer wings 6, 8 are compressed for assembly, they act on the sprung fingers 10, 12 forcing them together. Even in the compressed state, however, there are gaps between the front parts of the outer wings 6, 8 and the sprung fingers 10, 12 to allow for the deflection opening the retention pegs 14, 16.

As described above, the projection 48 of the drag link acts on the both the sprung fingers 10, 12 and the coin to dispense the coin. Alternatively, the projection 48 may act on the coin alone, with the front edge of the coin acting on the coin retention pegs 14, 16 to force them apart.

In the embodiment discussed above, the base is formed separately from the tube and is removably fitted to the tube. However, the base can be formed integrally with the tube or permanently attached to the tube.

As a result of the invention, coin retention pegs can be provided which prevent coins from falling out of the coin tube, but which do not interfere negatively with the dispensing operation or cause jams when there are only a few coins remaining in the coin tube, as in the prior art discussed above. Furthermore, the base can be used to improve the dispensing operation, for example, by enabling the coins to be "shot out". Because the inner edges of the sprung fingers meet in the rest position, this protects against the first coin falling through the base, compared with the prior art, where coins can fall through the slot for the dispensing arm. This arrangement enables a more controlled dispensing operation, which guides the coin horizontally thus making it easier to get the last coin out. Also, the base can be shaped to be used as a designator, that is, to determine the size of the gap for the coin to pass through. Also, the bases can be manufactured and sold separately from the tubes.

The use of the drag link to open the pegs can give a controlled release of the coins. The fact that the pegs are pivoted about a substantially vertical axis, preferably from beneath the coin, can stop the coin from being pushed downwards and potentially jamming as it is released.

Figure 6C:
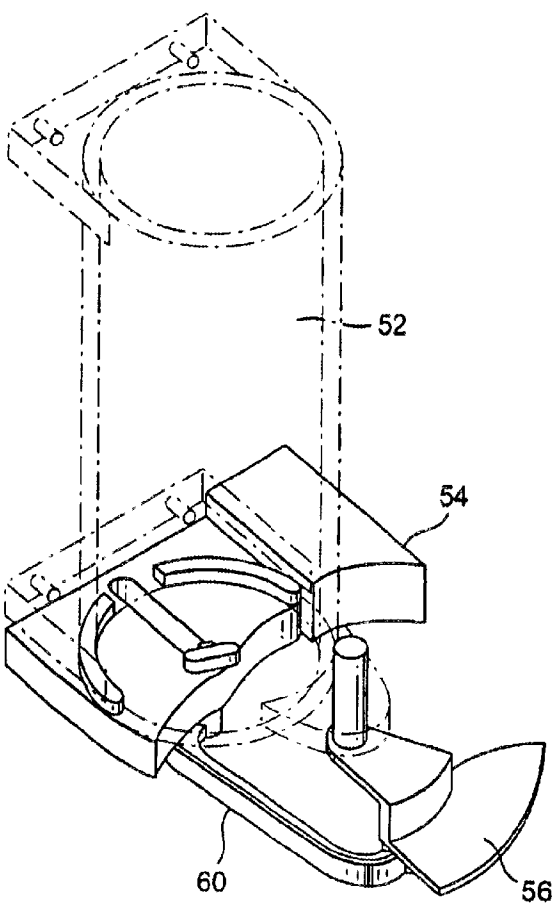
FIGS. 6A, 6B and 6C are views of another base for a coin tube shown in a sequence of operational positions.
Figure 6B:
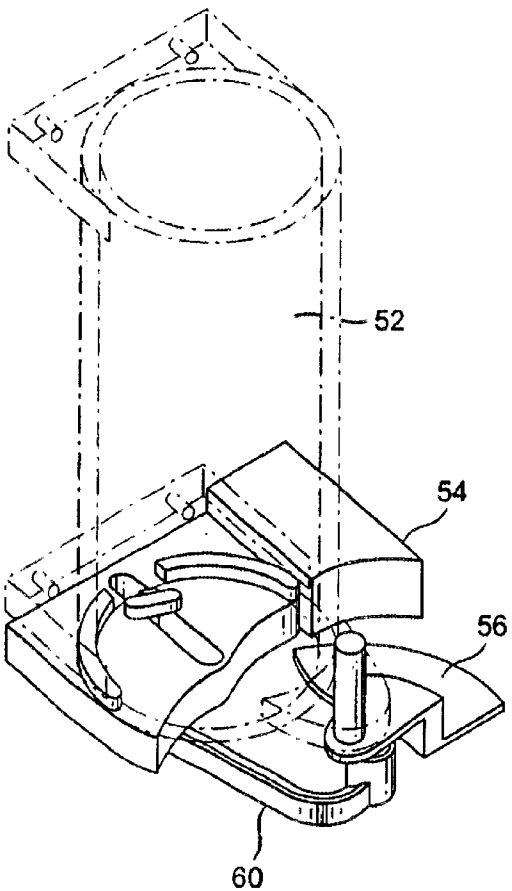
Figure 6A:
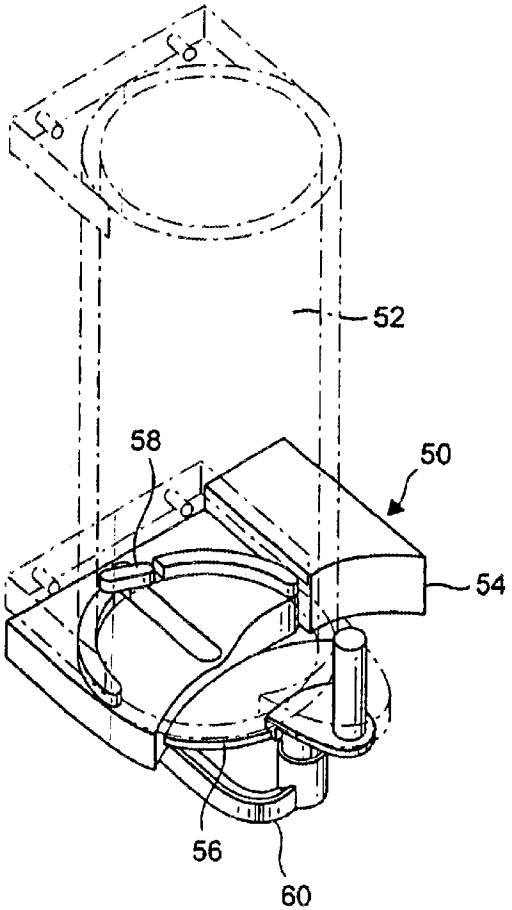

Another embodiment is shown in FIGS. 6A, 6B and 6C.

As shown in FIGS. 6A to 6C, a base 50 for a coin tube 52 includes a fixed base part 54. The fixed base part 54 extends to cover approximately ¾ of the area of the bottom of the tube, and has a slot in it to receive part of a drag link 58, similar to the prior art discussed in the introduction. The fixed base part 54 has a curved outer edge. In addition, the base includes a movable part 56, in the form of a quadrant. The quadrant 56 is rotatably mounted on an axis. The quadrant 56 includes a step. The quadrant 56 is coupled to the drive mechansim of the drag link, driven by a motor (not shown).

In the rest, or home, position, the outer edge of the quadrant 56 meets the curved edge of the fixed base part 54, thereby increasing the area of the lowermost coin that is supported or covered by the base 50. This reduces known problems of first coin fall through and also makes it more difficult to access the coin tube from below. When a coin is to be dispensed, the drag link 58 moves along the slot in the fixed base part 54 and acts on the rear of the lowermost coin in a known manner to move the coin. At the same time, the quadrant 56 is rotated away from the fixed base part 54, thereby revealing an opening in the base part through which the coin is removed from the coin tube under the action of the drag link 58 (FIG. 6B). The movement of the drag link 58 and the rotating quadrant 56 are associated by a link 60 so that they are synchronised, and both are driven by the same motor (not shown). When the drag link 58 is at its furthestmost point in the dispensing direction, the quadrant 56 has completed ½ a rotation (see FIG. 6C). Then the quadrant 56 continues to rotate and it and the drag link return to the rest position. (FIG. 6A).

Various modifications to the second embodiment are envisaged. For example, the stepped portion of the quadrant can be shaped to interconnect with the outer wall of the tube to enclose the coin stack. Also, shapes other than a quadrant can be used as the movable base part.

The principles underlying the embodiments can be applied to other types of coin stores, and other types of dispensing means.

What is claimed is:

1. An assembly comprising a coin store, means for dispensing coins from the coin store and means for opening part of the coin store to enable coins to be dispensed, wherein the dispensing means and the opening means are interconnected.

2. An assembly comprising a coin store, means for dispensing coins from the coin store and means for opening part of the coin store to enable coins to be dispensed, wherein the dispensing means acts directly on the opening means.

3. An assembly comprising a coin store, means for dispensing coins from the coin store and means for opening part of the coin store to enable coins to be dispensed, wherein the dispensing means is used to operate the opening means or the opening means is used to operate the dispensing means.

4. An assembly as claimed in claim 1, 2 or 3 wherein the arrangement is such that the dispensing means and the opening means operate together, including when there are no coins in the coin store.

5. An assembly as claimed in claim 1, 2 or 3 wherein the dispensing means and the opening means operate simultaneously.

6. An assembly as claimed in claim 1, 2 or 3 wherein the opening means begins to open before the dispensing means contacts a coin.

7. An assembly as claimed in claim 1, 2 or 3 wherein the coin store comprises a coin tube.

8. An assembly as claimed in claim 1, 2 or 3 wherein the dispensing means comprises a drag link.

9. An assembly as claimed in claim 1, 2 or 3 wherein the opening means comprises movable means for retaining coins within the coin store.

10. An assembly as claimed in claim 9 wherein the retaining means comprises a base part movable from a position in which it extends underneath the coin store for supporting coins to a position away from the lower part of the coin store.

11. A base for a coin store comprising an essentially planar part for supporting a coin or coins and retaining means for retaining coins within the coin store in use, the retaining means comprising at least one part extending essentially perpendicular to the planar part of the base, wherein the retaining means comprises a plurality of fingers arranged in the planar part of the base.

12. A base for a coin store comprising an essentially planar part for supporting a coin or coins and movable retaining means for retaining coins within the coin store in use, the retaining means comprising at least one part extending essentially perpendicular to the planar part of the base, wherein the retaining means are movable about an axis essentially perpendicular to the planar part of the base.

13. A base as claimed in any one of claims 11 and 12 wherein the retaining means are resiliently mounted.

14. A base as claimed in claim 12 wherein the part of the retaining means extending essentially perpendicular to the planar part of the base comprises a plurality of retaining pegs.

15. A base as claimed in claim 12 wherein the retaining means comprises a plurality of fingers arranged in the planar part of the base.

16. A base for a coin store comprising a fixed first base part for supporting a coin or coins to be dispensed from the base, and a second base part, wherein the second base part is movable relative to the first base part.

17. A base as claimed in claim 16 wherein the second base part is rotatable relative to the first base part.

18. A base as claimed in claim 16 or claim 17 wherein the second base part is in the form approximately of a quadrant of a circle.

19. A base for a coin store comprising:

an essentially planar part for supporting a coin or coins; and retaining means for retaining coins within the coin store in use, the retaining means including:

a plurality of fingers arranged in the planar part of the base, and at least one part extending essentially perpendicular to the planar part of the base having a plurality of retaining pegs.

20. An assembly comprising:

a coin store;

a drag link;

a base for the coin store including an essentially planar part for supporting a coin or coins and retaining means for retaining coins within the coin store in use, the retaining means including at least one part extending essentially perpendicular to the planar part of the base; and means for opening part of the coin store to enable coins to be dispensed, wherein the drag link and the opening means are interconnected.

21. An assembly comprising:

a coin store;

a drag link;

a base for the coin store including an essentially planar part for supporting a coin or coins and retaining means for retaining coins within the coin store in use, the retaining means including at least one part extending essentially perpendicular to the planar part of the base, wherein the retaining means comprises a plurality of fingers arranged in the planar part of the base; and means for opening part of the coin store to enable coins to be dispensed, wherein the drag link and the opening means are interconnected, and wherein the drag link acts on the fingers.

22. An assembly as claimed in claim 21 wherein the base comprises a pair of fingers, and the dispensing means extends between the pair of fingers.

23. An assembly comprising:

a coin store;

a base for the coin store including a first base part for supporting a coin or coins, and a second base part, wherein the second base part is movable relative to the first base part;

means for dispensing coins from the coin store; and means for opening part of the coin store to enable coins to be dispensed, wherein the opening means comprises movable means for retaining coins within the coin store, and wherein the dispensing means and the opening means are interconnected.

24. An assembly as claimed in claim 23 wherein the dispensing means extends through a slot in the first base part.

* * * * *